US006293766B1

(12) United States Patent
Blotenberg

(10) Patent No.: US 6,293,766 B1
(45) Date of Patent: Sep. 25, 2001

(54) PROCESS FOR OPERATING A COMPRESSOR WITH A DOWNSTREAM USER, AND UNIT OPERATING ACCORDING TO THIS PROCESS

(75) Inventor: Wilfried Blotenberg, Dinslaken (DE)

(73) Assignee: Man Turbomaschinen AG GHH Borsig, Oberhausen (DE)

( * ) Notice: Subject to any disclaimer, the term of this patent is extended or adjusted under 35 U.S.C. 154(b) by 0 days.

(21) Appl. No.: 09/470,496

(22) Filed: Dec. 22, 1999

(30) Foreign Application Priority Data

Dec. 29, 1998 (DE) ..... 198 60 639

(51) Int. Cl.[7] ..... F04D 27/00
(52) U.S. Cl. ..... 417/300; 417/282; 417/295
(58) Field of Search ..... 417/282, 292, 417/295, 300, 301, 307, 309; 60/409, 411, 39.281

(56) References Cited

U.S. PATENT DOCUMENTS

| | | | | |
|---|---|---|---|---|
| 3,860,363 | * | 1/1975 | Silvern et al. | 417/295 X |
| 4,074,521 | * | 2/1978 | Smith | 60/39.281 |
| 4,212,599 | * | 7/1980 | Lantermann | 417/295 |
| 4,392,347 | * | 7/1983 | Shows | 417/295 X |
| 4,403,920 | * | 9/1983 | Lantermann | 417/295 |
| 4,531,359 | * | 7/1985 | Hitzelberger et al. | 417/295 X |
| 4,576,054 | * | 3/1986 | Lalin | 73/863.03 |
| 4,798,521 | * | 1/1989 | Schmidt et al. | 417/295 |
| 4,884,545 | * | 12/1989 | Mathis | 123/447 |
| 5,117,799 | * | 6/1992 | Suzuki et al. | 123/561 |
| 5,199,853 | * | 4/1993 | Padden | 417/295 X |
| 5,851,293 | * | 12/1998 | Lane et al. | 118/715 |
| 6,093,372 | * | 7/2000 | Wallace et al. | 422/111 |

FOREIGN PATENT DOCUMENTS

| | | |
|---|---|---|
| 1 503 568 | 1/1971 | (DE) . |
| 1 648 501 | 8/1971 | (DE) . |
| 33 01 049 | 7/1983 | (DE) . |
| 623996 | 9/1978 | (RU) . |

OTHER PUBLICATIONS

F. Kluge, Mar. 19, 1941, Regelung Von Kreiselverdichtern, German.

* cited by examiner

*Primary Examiner*—John E. Ryznic
(74) *Attorney, Agent, or Firm*—McGlew and Tuttle, P.C.

(57) ABSTRACT

A compressor, especially for compressing the fuel gas for a gas turbine, is controlled by a throttling member (9) arranged on the intake side of the compressor as a function of the gas consumption of the user (7) such that the flow cross section is reduced during a reduction in gas consumption. The intake-side throttling member may be additionally controlled as a function of the pressure on the intake side of the compressor. Additional control circuits, especially an end pressure controller (19), which maintains the end pressure by acting on the guide vanes or on the speed of rotation of the compressor, and/or a pump surge limiter (33), which acts on a blow-by valve (29) connecting the outlet side to the intake side of the compressor (3), may be additionally present.

23 Claims, 1 Drawing Sheet

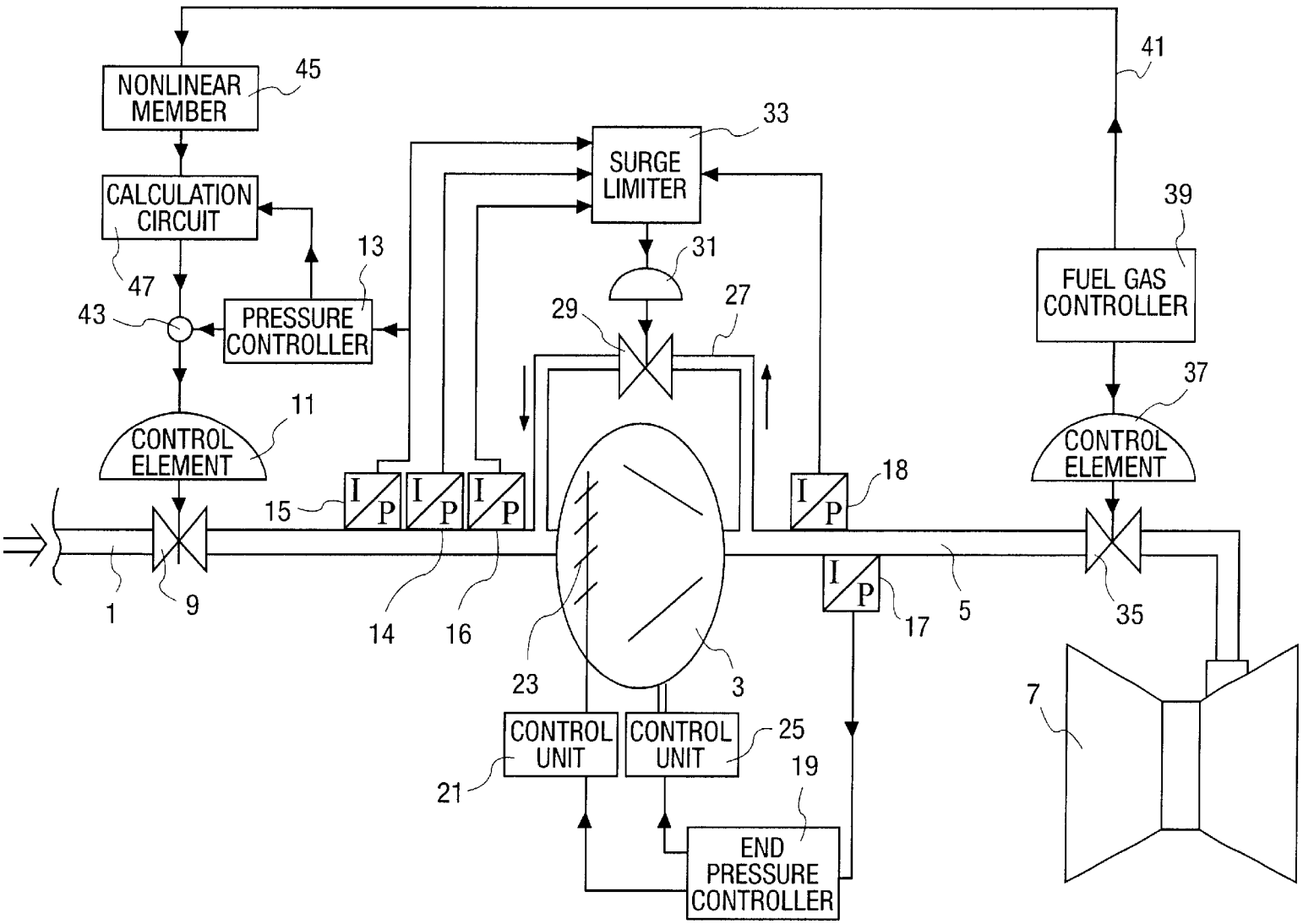
FUEL GAS CONTROLLER
CONTROL ELEMENT
SURGE LIMITER
PRESSURE CONTROLLER
NONLINEAR MEMBER
CALCULATION CIRCUIT
CONTROL ELEMENT
CONTROL UNIT
CONTROL UNIT
END PRESSURE CONTROLLER
I P
1
3
5
7
9
11
13
14
15
16
17
18
19
21
23
25
27
29
31
33
35
37
39
41
43
45
47

PROCESS FOR OPERATING A COMPRESSOR WITH A DOWNSTREAM USER, AND UNIT OPERATING ACCORDING TO THIS PROCESS

FIELD OF THE INVENTION

The present invention pertains to a compressor with a downstream user with variable gas output. The present invention also pertains to a unit operating according to this process with a compressor and a downstream user. The present invention is applicable preferably but not exclusively to a fuel gas compressor unit connected to a pipeline, which supplies a gas turbine with compressed fuel gas.

BACKGROUND OF THE INVENTION

It is necessary in many compressor applications to maintain both the intake pressure (inlet pressure) and the end pressure (outlet pressure) of the compressor at a constant value. The control elements used for this are a throttling member on the intake side of the compressor as well as control units, with which the position of the guide vanes and/or the speed of rotation of the compressor can be changed. The compressor delivers the compressed gas with an end pressure that is to be held at an essentially constant pressure to a user or to a process in which the gas is processed. This user of this process usually has control units of its own for changing or controlling the gas throughput, e.g., a throttling member at the inlet of the user or process.

It has been known that the compressor may be equipped with at least three control circuits to maintain the intake pressure and the end pressure at a constant value and to prevent the flow instabilities. An end pressure controller usually acts on the guide vanes of the compressor and/or on a means for adjusting the speed of rotation. An intake pressure controller acts on the throttling member on the intake side of the compressor. Furthermore, a pump surge limiter is provided, which acts on a blow-by valve connecting the outlet side to the intake side of the compressor in order to ensure a minimum flow rate through the compressor in the case of excessively low flow rate of the compressor by blowing over flow media from the delivery side to the intake side.

Each of these three control circuits affects the other. The absence of instabilities is ensured only by a careful and mutually coordinated design of the control circuits.

The working points and the dynamic behavior of the control circuits are designed for a normal value of the flow rate of the compressor and consequently of the gas throughput at the outlet of the compressor. Even though the control circuits are able, if a sudden change occurs in the gas throughput needed on the user side, to follow such changes in the gas flow rate to a certain extent, they are inherently able to do so with a sluggish time response only, which it not sufficient for a rapid elimination of changes or disturbances in the user-side gas output and may also cause the control circuits to mutually affect one another and to engage in an undesired interaction.

SUMMARY AND OBJECTS OF THE INVENTION

The primary object of the present invention is to operate a compressor with a downstream user such that its control can respond sufficiently rapidly to changes in the user-side gas output.

According to the invention a process is provided for operating a compressor with variable gas output and with a downstream user. A throttling member is arranged on the intake side of the compressor and is controlled as a function of the gas consumption of the user. A cross section of the throttling member is reduced when the gas consumption decreases.

The throttling member may additionally be controlled as a function of the gas pressure on the intake side of the compressor. The intake-side throttling member may be controlled by an intake pressure controller such that the intake-side pressure at the compressor inlet is maintained at a constant value, and such that a signal representing the value of the gas consumption at the user is additionally sent to said intake pressure controller.

The intake-side throttling member may be controlled by an adjusting signal, which is formed by linking a signal corresponding to the intake pressure of the compressor with the gas consumption at the user. This linkage may be performed by addition and/or by multiplication. The signal representing the gas consumption may be changed by a nonlinear member.

The end pressure at the outlet of the compressor may be maintained at an essentially constant value by a pressure controller, which acts on the position of the guide vanes and/or on the speed of rotation of the compressor drive.

A blow-by section connecting the outlet of the compressor to the intake side of the compressor may be controlled by a pump surge limiter such that the flow rate of the compressor does not drop below a minimum.

Time constants of the controller controlling the intake-side throttling member may be selected to be such that the throttling member responds more rapidly to changes in the user-side gas consumption than to changes in the pressure on the intake side of the compressor.

The intake side of the compressor may be connected to a pipeline. The user may be a gas turbine, which burns the gas compressed by the compressor.

According to another aspect of the invention a unit or system is provided with a compressor and with a downstream user. The system has a throttling member on the intake side of the compressor and with a control unit for changing the gas throughput through the user. The controller controls the intake-side throttling member as a function of the gas throughput of the user.

A throttling member arranged on the intake side of the compressor is controlled according to the present invention as a function of the user-side gas discharge, preferably such that the throttling member is adjusted proportionally to a reduction in the user-side gas throughput such that the pressure loss over the intake-side throttling member remains constant even at reduced flow. An undesired interaction with the other control circuits is thus reduced to a minimum.

One embodiment of the present invention will be explained in greater detail below on the basis of a flow and control chart of a compressor with downstream gas turbine, which compressor is connected to a gas pipeline.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

In the drawings:

The only FIGURE is a flow and control chart of a compressor with downstream gas turbine, which compressor is connected to a gas pipeline according to the system of the invention.

DESCRIPTION OF THE PREFERRED EMBODIMENT

Referring to the drawing in particular, the system or unit of the invention has a pipeline 1, in which fuel gas, especially natural gas, is delivered. The intake side of a compressor 3, which compresses the gas, is connected to the pipeline 1. The compressed fuel gas is fed via the outlet line 5 of the compressor to a gas turbine 7, which generates drive power by burning the compressed gas.

A throttling member 9 is provided having an opening cross section, which is controlled via a final control element 11 by an intake pressure controller 13. The intake pressure controller 13 receives a control signal from a pressure sensor 15 arranged downstream of the throttle valve 9. The throttling member 9 is arranged on the intake side of the compressor 3. The pressure sensor 15 detects the pressure on the intake side of the compressor 3. The sensor 15, the controller 13 and the throttling member 9 form an intake pressure control circuit for maintaining the pressure on the intake side of the compressor 3 at a constant value.

A pressure sensor 17, which detects the end pressure (outlet pressure) of the compressor 3 and sends a corresponding signal to an end pressure controller 19, is arranged on the delivery-side outlet line 5 of the compressor 3. This end pressure controller generates a control signal for a control unit 21 for adjusting the guide vanes 23 of the compressor and/or a control signal for a control unit 25 for changing the speed of rotation of the drive (not shown) of the compressor 3. The pressure sensor 17, the controller 19 and the control unit 21 or 25 form an end pressure control circuit for maintaining the pressure on the outlet side of the compressor 3 at a constant value.

The outlet line 5 of the compressor 3 is connected to the intake side of the compressor via a blow-by line (bypass) 27 with a blow-by valve 29. This valve 29 can be controlled via a final control element 31, which is actuated by a control signal from a pump surge limiter 33. The pump surge limiter 33 operates a flow controller with variable set point, wherein the set point is controlled as a function of the current delivery head (enthalpy difference) of the compressor 3. The pump surge limiter 33 receives as input variables signals for the intake-side pressure (from the pressure sensor 15) and the intake-side temperature (from a temperature sensor 14) as well as the outlet-side pressure (end pressure), which is detected by a pressure sensor 18. The pressure sensor 18 may, of course, be identical to the pressure sensor 17. The pump surge limiter 33 determines the enthalpy difference and the set point derived therefrom from these input variables. The pump surge limiter 33 additionally receives as the input variable the actual value of the intake-side flow from a flow sensor 16.

A fuel control valve (throttle valve) 35, which is controlled by a fuel gas controller 39 via a final control element 37, is located at the inlet of the gas turbine 7 connected to the compressor outlet line. The fuel gas controller 39 adjusts the fuel gas valve 35 such that exactly the amount of fuel gas that is needed to generate the currently required turbine output is fed into the combustion chamber of the gas turbine 7. The fuel gas controller 39 of the gas turbine 7 is primarily a speed governor, which regulates the speed of the gas turbine to a predetermined set point. Additional protective functions, e.g., protection from overheating, flow instability, insufficient speed, etc., are frequently integrated within the fuel gas controller.

A control signal, which corresponds to the instantaneous position of the fuel gas valve 35 and consequently to the instantaneous value of the gas feed to the turbine 7, is taken from the fuel gas controller 39 via a control line 41. It may be, in particular, a control signal that is equal or proportional to the control signal sent from the controller 39 to the final control element 37 of the throttle valve 35. However, the control signal may also be taken directly from the position of the fuel gas valve 35 without being generated by the controller 39.

This control signal, which corresponds to the instantaneous gas throughput through the turbine 7, is sent via the control line 41 to a linkage point 43, where it is linked with the control signal for the intake-side throttling member 9, which latter control signal is generated by the intake pressure controller 13. The manner of linkage may be a simple addition or even a multiplication, but it is a linkage acting in the same sense, so that the intake-side throttling member 9 is also increasingly throttled with increasing throttling of the fuel gas supply to the gas turbine 7. A nonlinear member 45 may be arranged upstream of the linkage point 43. The nonlinear member 45 may be a nonlinear calculation member and/or a nonlinear amplification member and can change the control signal sent via the line 41 to the linkage point 43 such that nonlinearities of the system will be compensated.

The system according to the exemplary embodiment operates as follows.

The controllers 13, 19, 33, 39 are designed for a design point at which the pressure in the pipeline 1 corresponds to the desired or necessary intake pressure of the compressor 3, the compressor 3 is operated at nominal speed, and the guide vanes are in the nominal position. The intake-side throttling member 9 is now open in the nominal position. The fuel control valve 37 at the inlet of the gas turbine 7 is likewise in the nominal position, which corresponds to the rated output of the gas turbine. Since variations in the pressure in the pipeline 1 take place relatively slowly, the controllers 13 and 19 provided to eliminate these variations are designed for a relatively slow time constant.

If the pressure in the pipeline increases, the delivery head of the compressor 3 must be reduced in order to maintain the end pressure at a constant value. To do so, the position of the guide vanes 22 is changed by the end pressure controller 19 via the final control elements 21 or 25 in the direction of a closed position and/or the speed of rotation of the compressor 3 is reduced. The pressure difference over the intake-side throttling member 9 decreases because of the resulting reduction in the flow through the compressor 3, so that the throttling member 9 must close to a corresponding extent. Moreover, since the delivery head can be arbitrarily reduced because of the physical limits of the compressor 3, the intake pressure controller 13 must additionally intervene above a certain pressure in the pipeline 1 and throttle the intake-side throttling member 9 to the extent that the inlet pressure of the compressor will again correspond to the nominal value.

If an output smaller than the rated output is now needed from the gas turbine 7, the gas throughput through the gas turbine 7 is throttled by partially closing the fuel gas control valve 35 and the gas turbine is adjusted to a partial load point. The throttling member 9 on the intake side of the compressor 3 also closes correspondingly more in this case according to the present invention in order to maintain the pressure drop at the intake-side throttling member 9 at a constant value despite the reduced fuel gas throughput through the turbine 7. The load changes of the gas turbine 7 inherently take place much more rapidly than do the variations in the pressure in the pipeline 1. The control system is therefore designed such that it is able to eliminate disturbances, which are caused by the gas turbine 7, much more rapidly than disturbances caused by variations in the pressure in the pipeline 1.

According to the preferred embodiment of the present invention being described, a control signal for the throttling member 9 (expressed in % of the total closing stroke from the fully open position), which control signal is generated by the intake pressure controller 13, is multiplied for this purpose by the control signal for the throttling of the fuel gas control valve 35 (likewise expressed in % of the total closing stroke from the fully open position) in a calculation circuit 47, which is associated with the linkage point 43. The result of the multiplication is an additional control signal, which is added to the signal of the intake pressure controller 13 in the linkage point 43 and brings about an additional throttling of the intake-side throttling member 9. One or more nonlinear elements (calculation elements or amplification members) are provided to compensate the nonlinearities of the system. Linearization can thus be achieved especially in case the characteristics of the fuel gas control valve 35 and of the intake-side throttling member 9 have different characteristics or different adjustment characteristics.

The adjusting characteristic of the intake pressure controller 13 has a relatively sluggish setting and its parameters are adapted to the dynamics of the pipeline 1. Its slowly changing manipulated variable is added in the linkage point 43 to the adjusting command derived from the position of the fuel gas control valve 35.

According to a concrete exemplary embodiment, the system may operate as follows. It shall be assumed that the entire system is near the nominal working point. The fuel gas control valve 35 and the guide vanes 23 of the compressor are in the nominal position. The compressor 3 is operated at a nominal speed. It shall also be assumed that there is a relatively high pressure in the pipeline 1 and that the throttling member 9 is therefore throttled by 10% by the intake pressure controller 13, i.e., the opening cross section is 90% of the full opening cross section.

The gas turbine 7 shall now be adjusted into a partial load point. To do so, the fuel gas control valve 35 is throttled by, e.g., 30%, i.e., its opening cross section will be 70% of the full opening cross section after the flow regulation. The corresponding adjusting command from the fuel gas controller 39 for the control valve 35 (or also a signal taken directly from the position of the fuel gas control valve 35) is sent to the calculation circuit 47 and is multiplied by the signal from the controller 13 for the 10% throttling of the throttling member 9 there. The result is an additional adjusting signal for an additional closing of the throttling member 9 by another 3% (10% of the existing throttle position of the throttling member 9 multiplied by a 30% load change of the turbine 7). As a result, the throttling member 9 passes immediately over from the 90% open position to the 87% open position.

Should the pressure in the pipeline 1 change independently herefrom, this is detected by the intake pressure controller 13 via the pressure sensor 15 and it additionally adjusts the intake-side throttling member 9 with its slow time response. Since this change takes place slowly, it cannot affect the rapid adjustment as a consequence of the superimposition of the adjusting command corresponding to the position of the fuel gas control valve 35 via the line 41.

While a specific embodiment of the invention has been shown and described in detail to illustrate the application of the principles of the invention, it will be understood that the invention may be embodied otherwise without departing from such principles.

What is claimed is:

1. A process for operating a compressor with a variable gas output, the process comprising;

arranging a throttling member on an intake side of the compressor;

controlling said throttling member as a function of a signal solely representing a gas flow delivered from the compressor.

2. A process in accordance with claim 1, wherein:

said signal directly represents said gas flow.

3. A process in accordance with claim 1, wherein:

said signal represents a desired said gas flow from said compressor.

4. A process in accordance with claim 1, wherein:

said signal represents a gas flow through a downstream throttling member arranged downstream from the compressor.

5. A process in accordance with claim 1, wherein:

said controlling reduces a flow cross section of said throttling member when said gas consumption decreases.

6. A process for operating a compressor with a downstream user and with variable gas output, the process comprising;

arranging a throttling member on an intake side of said compressor; and controlling the throttling member as a function of the gas consumption of the user, with a flow cross section of the throttling member being reduced when the gas consumption decreases.

7. The process in accordance with claim 6, wherein the throttling member is additionally controlled as a function of the gas pressure on the intake side of the compressor.

8. The process in accordance with claim 1, wherein the intake-side throttling member is controlled by an intake pressure controller such that the intake-side pressure at the compressor inlet is maintained at a constant value, and that a signal representing the value of the gas consumption at the user is additionally sent to the intake pressure controller.

9. The process in accordance with claim 8, wherein the signal representing the gas consumption is changed by a nonlinear member.

10. The process in accordance with claim 7, wherein the intake-side throttling member is controlled by an adjusting signal, which is formed by linking a signal corresponding to the intake pressure of the compressor with the gas consumption at the user.

11. The process in accordance with claim 10, wherein the linkage is performed by addition and/or by multiplication.

12. The process in accordance with claim 7, wherein time constants of the controller controlling the said intake-side throttling member are selected to be such that the throttling member responds more rapidly to changes in the user-side gas consumption than to changes in the pressure on the intake side of the compressor.

13. The process in accordance with claim 6, wherein the end pressure at the outlet of the compressor is maintained at an essentially constant value by a pressure controller, which acts on the position of the guide vanes and/or on the speed of rotation of the compressor drive.

14. The process in accordance with claim 6, wherein a blow-by section connecting the outlet of the compressor to the intake side of the compressor is controlled by a pump surge limiter such that the flow rate of the compressor does not drop below a minimum.

15. The process in accordance with claim 6, wherein the intake side of the compressor is connected to a pipeline and the user is a gas turbine, which burns the gas compressed by the compressor.

16. A compressor system, comprising:

a compressor;

a user connected to said compressor, downstream of said compressor;

a throttling member on an intake side of said compressor;

a control unit for changing the gas throughput through the user, wherein said controller controls said intake-side throttling member as a function of the gas throughput of said user.

17. The system in accordance with claim 16, wherein said throttling member is additionally controlled as a function of the gas pressure based on a sensor disposed on said intake side of said compressor.

18. The system in accordance with claim 17, wherein said intake-side throttling member is controlled by an intake pressure controller such that the intake-side pressure at said compressor inlet is maintained at a constant value, and that a signal representing the value of the gas consumption at said user is additionally sent to said intake pressure controller.

19. The system in accordance with claim 17, wherein said intake-side throttling member is controlled by an adjusting signal, which is formed by linking a signal corresponding to the intake pressure of said compressor with the gas consumption at said user.

20. The system in accordance with claim 19, wherein the linkage is performed by addition and/or by multiplication.

21. The system in accordance with claim 18, further comprising a nonlinear member wherein the signal representing the gas consumption is changed by said nonlinear member.

22. The system in accordance with claim 16, further comprising a pressure controller and a compressor drive associated with said compressor, wherein the end pressure at the outlet of said compressor is maintained at an essentially constant value by said pressure controller, which acts on the position of guide vanes and/or on the speed of rotation of said compressor drive.

23. The system in accordance with claim 16, further comprising a blow-by section connecting the outlet of said compressor to the intake side of said compressor and a pump surge limiter controlling said blow-by section such that the flow rate of the compressor does not drop below a minimum.

* * * * *